US006032632A

United States Patent [19]

Bolenz et al.

[11] Patent Number: 6,032,632

[45] Date of Patent: Mar. 7, 2000

[54] STARTING AND DRIVING UNIT FOR INTERNAL COMBUSTION ENGINE OF MOTOR VEHICLE

[75] Inventors: Klaus Bolenz, Schwieberdingen; Siegfried Schustek, Ditzingen; Udo Bondroit, Hannover, all of Germany

[73] Assignee: Robert Bosch GmbH, Stuttgart, Germany

[21] Appl. No.: 08/866,903

[22] Filed: May 30, 1997

[30] Foreign Application Priority Data

Jun. 3, 1996 [DE] Germany ..... 196 22 239
Feb. 14, 1997 [DE] Germany ..... 197 05 610

[51] Int. Cl.[7] ..... F02N 11/04

[52] U.S. Cl. ..... 123/179.3; 123/179.4; 123/179.28; 290/31

[58] Field of Search ..... 123/179.3, 179.4, 123/179.25, 179.28; 290/31

[56] References Cited

U.S. PATENT DOCUMENTS 1,814,617 7/1931 Brown ..... 123/179.3
4,699,097 10/1987 Tanaka et al. ..... 123/179.3
4,898,038 2/1990 Kitamura ..... 123/179.28

FOREIGN PATENT DOCUMENTS 29 17 139 A1 11/1980 Germany .
30 48 972 A1 7/1982 Germany .
304897202 7/1982 Germany .
58 098 658 6/1983 Japan .

*Primary Examiner*—Andrew M. Dolinar
*Attorney, Agent, or Firm*—Michael J. Striker

[57] ABSTRACT

A driving and starting unit for an internal combustion engine of a motor vehicle has a driving element, a switching transmission, a coupling arrangable between a drive shaft of the internal combustion engine and the switching transmission, an electrical control device for receiving an outputting and switching signals for the driving element and the switching transmission, the switching transmission being formed as an automatic switching transmission, the driving element including a conventional starter and a starter/generator, the driving element being formed so that the driving element operates in dependence on outer conditions so as to activate one of the conventional starter, the starter/generator, and both the conventional starter and the starter/generator.

10 Claims, 2 Drawing Sheets

STARTING AND DRIVING UNIT FOR INTERNAL COMBUSTION ENGINE OF MOTOR VEHICLE

BACKGROUND OF THE INVENTION

The present invention relates to a starting and driving unit for an internal combustion engine of a motor vehicle.

Such driving units are well known, and one of them is disclosed for example in the German patent document DE 30 48 972 C2.

New driving concepts which are optimized in particular with respect to environmental protection and fuel consumption are preferably designed so that the internal combustion engine is turned off when the vehicle is stopped, for example at a traffic light or during operational phases in which no drive moment is transmitted from the internal combustion engine. Such an operational procedure can be performed by a START-STOP automatic operation (SSA) and INERTIA-USE automatic operation (IUA). In the vehicles with SSA the number of starts is increased relative to conventional vehicles from 30,000 to 200,000 and in the vehicles with IUA it is increased to more than 400,000. Mass-minimized conventional starters are equipped by special features for an SSA operation. The problem however resides in the open, non-lubricated transmission with a starter pinion and the toothed rim in which the pinion must be engaged during the start. For high starting numbers such a solution is no longer suitable. An aide to this is an oil-lubricated toothed rim.

In the above mentioned prior art, a pulse-starting device is proposed which has low wear and noise. The required starting energy is stored in an inertia-wheel which is freely rotatable on the crank shaft. For starting the internal combustion engine, the motor is accelerated to a sufficiently high rotary speed by closing the motor-side coupling.

For first starts at extremely low temperatures there are however not acceptable long winding-up times for the inertia-wheel. For subsequent starts in warm internal combustion engines, for example at a traffic light or at an end of a pushing phase also not acceptable winding-up times occur when a running-out of the inertia-wheel was allowed to the point of stoppage.

The same problem occurs in the device disclosed in the German patent document DE 29 17 139 A1. In this known driving unit an inertia mass of the crank shaft is turnable on and off, and the internal combustion engine during deceleration, during breaking or during pushing operation can run further by interruption of the drive train with a minimum rotary speed, for example the idle running rotary speed. During short-time stops, for example traffic light stops or the like, the drive train however is interrupted, the internal combustion engine is stopped, while the inertia mass is further rotated and then during subsequent starts of the internal combustion engine, it is again coupled through the coupling. It is therefore possible in the case of considerably dropped rotary speed of the inertia mass to use an electric motor in order to maintain the rotary speed of the inertia mass at a predetermined rotary speed level.

Generally with the use of a classic starter or a pulse start via a switchable inertia-wheel, the requirements for subsequent starts with respect to starting time, low noise, wear, service life, and electrical capacity for the high number of 400,000 starting cycles are satisfied only partially.

SUMMARY OF THE INVENTION

Accordingly, it is an object of present invention to provide a starting and driving unit for internal combustion of a motor vehicle, which avoids the disadvantages of the prior art.

In keeping with these objects and with others which will become apparent hereinafter, one feature of the present invention resides, briefly stated, in a drivin and starting unit in which the switching transmission is an automatic switching transmission. The starting device is composed of a conventional starter in combination with a starter/generator, and the operation of the driving unit is dependent on outer conditions, so that either the conventional starter, or the starter/generator, or both are activated.

When the tarting and driving device is designed in accordance with present invention, it eliminates the disadvantages of the prior art and in all starting phases automatically selects an optimal starting method.

In accordance with a further feature of the present invention, the outer conditions are temperatures of the internal combustion engine which are measured by a temperature sensor. With such an approach, the outer conditions can be determined directly on the internal combustion engine, since the temperature of the internal combustion engine is the best indicator for the corresponding starting conditions.

In accordance with still a further feature of the present invention, in the event of the cold internal combustion engine, the conventional starter and the starter/generator together perform the starting function. This provides for the advantage that in the starting phase two devices are available for producing the turning force.

In accordance with a further feature of the present invention, the conventional starter for the cold start is greatly reduced. Therefore a cold start can be performed at lower temperatures easier.

Still another feature of present invention is that at an internal combustion engine temperature over 30/40° C., the starting function is performed by the starter/generator alone. This has the advantage that in the start-stop operation and in the inertia-use the conventional starter is improved.

With the installed inertia-use automatic a time consumer turning-off is provided. This feature is advantageous when the board electrical system is not overloaded. It is advantageous when the starter/generator is formed as an electriconically commutated starter/generator machine, and it is arranged between the coupling and the automatic switching transmission. Here, as a replacement of the inertia-wheel, an efficient current generator is provided which can supply the board electrical system sufficiently with energy. Thereby the battery capacity is economized. Moreover, the starter/generator device operates substantially wear-free.

The starter/generator is formed as an electronically commutated starter/generator device and is connected to a gear which is arranged prior to the automatic switching transmission in the drive train. The use of the gear has the advantage since therefore the starter/generator device can be formed smaller and lighter.

The generator of the electronical commutated starter/generator device can be driveable both by the internal combustion engine and by the energy of the rolling vehicle. Therefore the kinetic energy of the vehicle can use for additional supply of the board electrical system.

Finally, the automatic switching transmission can be arranged so that during the rolling phase of the vehicle a speed which is suitable for a favorable efficiency of the generator is provided. This is the advantage that the properties of an automatic transmission are completely utilized by automatically adjusting the speed which is favorable for a current generation.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
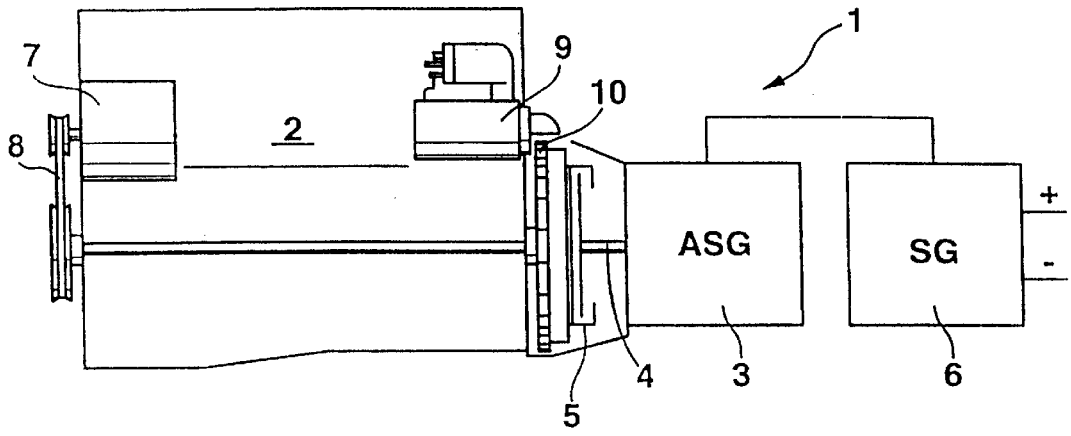
Fig. 1 (PRIOR ART)
FIG. 1 is a view showing a starting and driving unit in accordance with a prior art.

FIG. 1 shows a driving unit 1 with an internal combustion engine 2 and an automatic switching transmission 3. The switching transmission has an input shaft 4 which can be drivingly separated by a coupling 5 from the internal combustion 2. The actuation of the coupling 5 and the speed selection are performed in dependence on the speed or rotary speed of an electrical control device 6 through not shown servos. Moreover, a generator 7 is provided. It is driven by a belt drive 8 at the left side of the internal combustion engine 2 as shown in the drawings.

Figure 2:
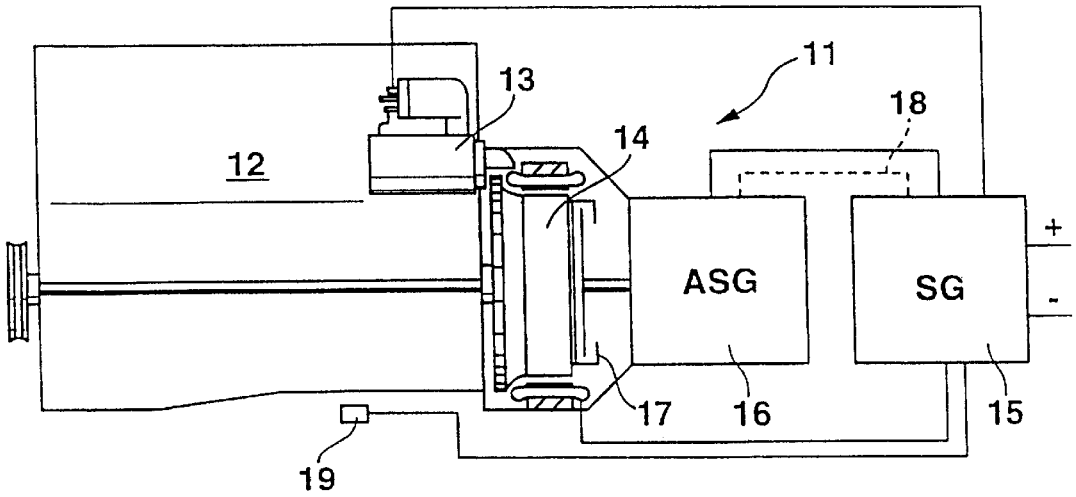
FIG. 2 is a view showing a first embodiment of the starting and driving unit in accordance with present invention.

A starter 9 is formed as a conventional pushing-screw starter and is located at the right side of internal combustion engine 2. It can turn and start the internal combustion engine 2 through a toothed rim 10 when needed. The control elements for the control device 6 and the starter 9 are not shown. An inertia disk is arranged under the toothed rim 10. FIG. 2 shows a drive unit 11 for an internal combustion engine 12 which also has a conventional starter 13. Here the reference numeral 14 identifies an electronically commutated inertia-wheel machine which can operate both as a starter and as a generator. The control of the starter/generator 14 is performed by a control device 15. In accordance with the invention, the operation of the drive unit 11 is performed so that with temperatures of the internal combustion engine under 30–40° C., the starter 13 and the starter/generator 14 operated as a motor together perform the starting function. At higher temperatures over 40° C., the starting function is performed exclusively by the wear-free starter/generator 14. An automatic switching transmission 16 is separated by an open coupling 17 from the starter/generator 14 during the starting process. The corresponding position of the automatic switching transmission 16 is communicated to a control device 15 through a control conductor 18 shown in a broken line. Moreover, a conductor leads from the control device 15 to a temperature sensor 19 of the internal combustion engine 12.

Figure 3:
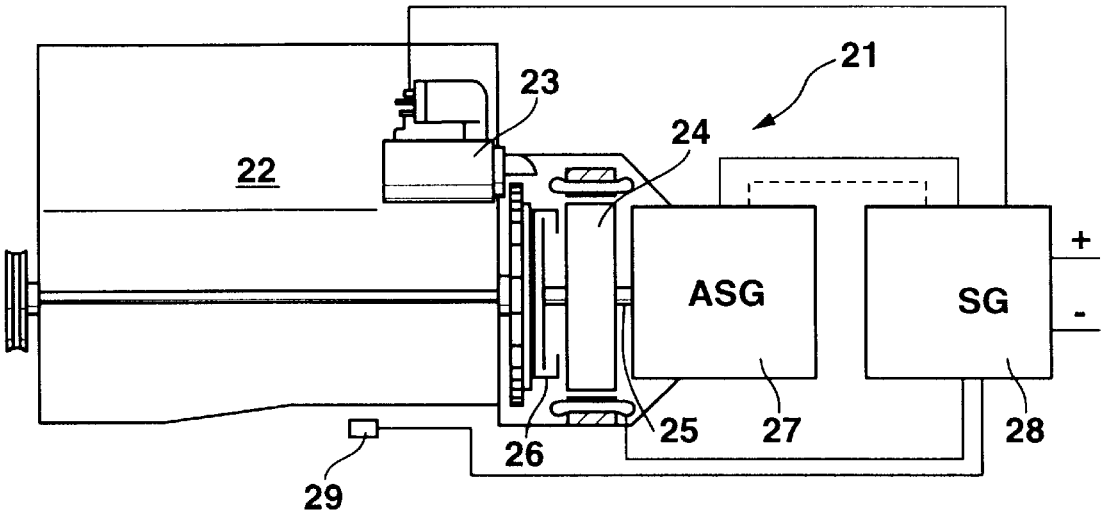
FIG. 3 is a view showing a second embodiment of the starting and driving unit in accordance with the present invention.

FIG. 3 shows a drive unit 21 for an internal combustion engine with a conventional starter 23 and an electronically commutated starter/generator device 24 arranged on an input shaft 25 of the transmission. In other words, the starter/generator device 24 is located in the drawing at the right side of a coupling 26. This device 24 forms with its rotor an inertia-wheel of the internal combustion engine 22. A temperature sensor is identified with reference numeral 29.

With temperatures of the internal combustion engine under 30–40° C., the conventional starter 23 and the starter/generator device 24 operating as a motor together provide the starting function. At higher temperatures of the internal combustion engine over 40° C. the starting functions are performed exclusively by the substantially wear-free starter/generator device 24. In order to make it possible, the coupling 26 must be closed and an automatic switching transmission 27 must be in a neutral position. A control device is identified with reference numeral 28.

Figure 4:
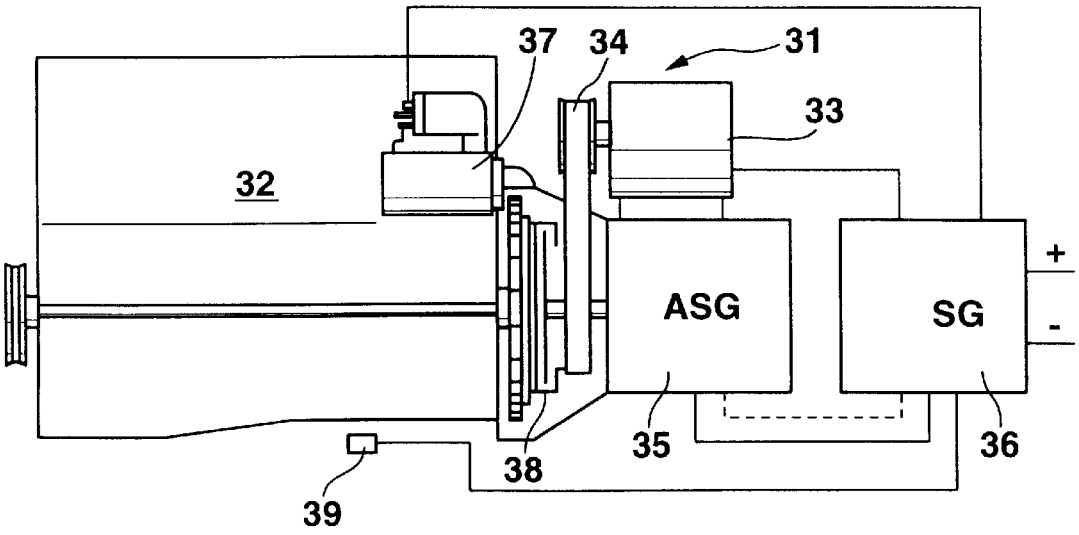
FIG. 4 is a view showing a third embodiment of the starting and driving unit of the present invention.

FIG. 4 finally illustrates a drive unit 31 of an internal combustion engine 32 in which an electronically commutated starter/generator device 33 is connected through a gear 34 of an automatic switching transmission 35 or by an intermediate shaft from the transmission outwardly or with the drive train. Also, an arrangement which is concentric to the input shaft of the transmission is recommended. A control device is identified with reference numeral 36 and the temperature sensor with reference numeral 39. The starter/generator device 33 is formed as the starter/generator device 24 of FIG. 3.

With temperatures of the internal combustion engine under 30–40° C., a conventional starter 37 and the starter/generator device 33 operating as a motor together perform the starting function. At high temperatures of the internal combustion engine, the starting function is performed exclusively by the substantially wear-free starter/generator machine 33. In order to make this possible, a coupling 38 must be closed and the automatic switching transmission 35 must be in a neutral position. It can be seen that as for the driving units 11, 21 and 31 of FIGS. 2, 3 and 4, for starts with temperatures of the internal combustion engine under 30–40° C., the inertia-wheel machine in the motor operation is designed for approximately the half of the dragging moment of the conventional starter in accordance with FIG. 1 at a cold start limiting temperature of −25 to −28° C. The conventional starter 13, 23 and 36 of the embodiments of FIGS. 2, 3, and 4 takes over the other half in the case of the cold start. In this way the structural dimensions both of the conventional starter and also the structural dimension of the inertia-wheel device over the starter/generator device are substantially reduced. The same is true for the power electronic system and the control device 15, 28 and 36, since substantially only half current value must be commutated for the full starting moment when compared with the inertia-wheel-starter-generator. Moreover, there is a possibility to reduce the conventional starter. In other words to design it predominantly for the cold start limiting temperatures of −25 to −28° C., and to contribute the high running support of the electronically commutated starter/generator device 24, 33. This means a further reduction of the conventional starters. When compared with the conventional starter in mind of FIG. 1, the switching number for the conventional starter 12, 23 and 37 of FIGS. 2, 3 and 4 reduces substantially to only the start per travel, when the motor temperature is under 30–40° C.

An inertial wheel device shown in FIG. 2 can be represented in many cases not by a currently conventional 12 volt battery because of the high voltage drop at the power semi-conductors at very high currents. A transition to a 24 volt boarding electrical system is needed.

In the embodiments of FIGS. 3 and 4, the 12-volt solutions are realizable. The starter/generator device of FIG. 4, depending on the gear 34, can be smaller and lighter. With the use of the currently utilized acceleration speeds, the gear ratio of 2.5–3 is possible. Then higher requirements to the synchronization of the transmission than now exist can be provided. The basis for this is the higher acting inertia moment of the transmitted starter/generator device 33 relative to the embodiment of FIG. 3. In the constructions of FIGS. 3 and 4 the inertia-wheel of the starter/generator device 24 or 33 must have a sufficient minimum inertia moment so that during the coupling process, the internal combustion engine 24 or 32 is not braced.

Load impacts during the switching in the drive train and the loads of the synchronization can be reduced by de-energizing of the generator during the switching process. An active synchronization is also recommended. In the embodiment of FIG. 2, the rotor inertia moment of the starter/generator 14 can completely replace the inertia-wheel of the embodiment of FIG. 1.

The starter/generator device 24 and 33, because of its size can supply in the generator operation, when compared to conventional generators, higher currents with comparably high efficiency into the board electrical system. For conventional operation an inertia-wheel device is designed for the full starter power in the generator region for smaller vehicles up to the middle class with broad over dimensioning. Despite this, such a device in the start-stop operation can be supplied only in connection with the greater battery for a compensating charge balance, since the electrical energy consumption during approximately ⅓ of the driving time must be covered by the battery. During inertia-use operation, the situation worsens further since the internal combustion engine can stop up to ⅔ of the driving time when additionally ⅓ rolling is performed without running internal combustion engine.

In the embodiment of FIG. 2 a very strong generator is designed so that it is sufficient for a start-stop operation. During transition to the inertia-use operation in general a compensating charge balance can be obtained only in connection with a consumer turning-off and a substantially greater battery.

This problem is substantially important in the embodiment of the FIGS. 3 and 4. Here the generator which represents the inertia moment of the inertia-wheel is driven by the kinetic energy of the rolling vehicle. By the automatic transmission, selectively can be supplied with open switching coupling for a favorable rotary speed of the input shaft of the transmission or the generator shaft by automatic adjustment of the favorable speed, so that high generator efficiency is obtained.

Generally speaking, in the solutions in accordance with FIGS. 3 and 4, when compared with an inertia wheel device of FIG. 2, for the full starting power a comparatively easy, relatively voluminous but cost-favorable hybrid starting device is provided, which covers a good generation function in connection with a somewhat increased battery.

It is also contemplated in accordance with the present invention to design the driving and starting unit for an internal combustion engine as shown in FIGS. 2–4 so that the operation of the driving unit is dependent on outer conditions, so that either the conventional starter, or the starter/generator, or both are activated.

It will be understood that each of the elements described above, or two or more together, may also find a useful application in other types of constructions differing from the types described above.

While the invention has been illustrated and described as embodied in starting and driving unit for internal combustion engine of motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A driving and starting unit for an internal combustion engine of a motor vehicle, comprising driving means; a switching transmission; a coupling arrangeable between a drive shaft of the internal combustion engine and said switching transmission; an electrical control device for receiving an outputting and switching signals for said driving means and said switching transmission, said switching transmission being formed as an automatic switching transmission, said driving means including a conventional starter and a starter/generator, said driving means being formed so that said driving means operate in dependence on sensed outer conditions so as to selectively activate one of said conventional starter, said starter/generator, and both said conventional starter and said starter/generator.

2. A driving and starting unit as defined in claim 1, wherein said driving means is formed so that when the internal combustion engine is cold said conventional starter and said starter/generator both perform a starting function.

3. A driving and starting unit as defined in claim 1, wherein said driving means is formed so that with a temperature of the internal combustion engine over 30–40° C. a starting function is performed by said starter/generator only.

4. A driving and starting unit as defined in claim 1, wherein said starter/generator is arrangeable between said coupling and the internal combustion engine.

5. A driving and starting unit as defined in claim 1, wherein said starter/generator is formed as an electronically commutated starter/generator device and arranged between said coupling and said automatic switching transmission.

6. A driving and starting unit as defined in claim 1, wherein said starter/generator is formed as an electronically commutated starter/generator device; and further comprising a gear arranged before said automatic switching transmission in a drive train and connected with said electronically commutated starter/generator machine.

7. A driving and starting unit as defined in claim 1, wherein said starter/generator device has a generator driveable by the internal combustion engine and also by an energy of a rolling vehicle.

8. A driving and starting unit as defined in claim 7, wherein said automatic switching transmission is formed so that during a rolling phase of a vehicle a suitable speed is adjustable for favorable efficiency of said generator.

9. A driving and starting unit for an internal combustion engine of a motor vehicle, comprising driving means; a switching transmission; a coupling arrangeable between a drive shaft of the internal combustion engine and said switching transmission; an electrical control device for receiving and outputting of switching signals for said driving means and said switching transmission, said switching transmission being formed as an automatic switching transmission, said driving means including a conventional starter and a starter/generator, said driving means being formed so that said driving means operate in dependence on outer conditions so as to activate one of said conventional starter, said starter/generator, and both said conventional starter and said starter/generator; and a temperature sensor for sensing temperatures of the internal combustion engine and cooperating with said driving means so as to activate one of said conventional starter, said starter/generator, and both said conventional starter and said starter/generator.

10. A driving and starting unit for an internal combustion engine of a motor vehicle, comprising driving means; a switching transmission; a coupling arrangeable between a drive shaft of the internal combustion engine and said switching transmission; an electrical control device for receiving and outputting of switching signals for said driving means and said switching transmission, said switching transmission being formed as an automatic switching transmission, said driving menas including a conventional starter and a starter/generator, said driving means being formed so that said driving means operate in dependence on outer conditions so as to activate one of said conventional starter, said starter/generator, and both said conventional starter and said starter/generator, said driving means being provided with an inertia-use automatic means and provides a temporary turning-off.

* * * * *